US005230404A

United States Patent [19]

Klein

[11] Patent Number: 5,230,404

[45] Date of Patent: Jul. 27, 1993

[54] ERECTION SCAFFOLDING WHICH IS MOVABLE IN AN ELEVATOR SHAFT FOR THE MOUNTING OF SHAFT EQUIPMENT

[75] Inventor: Horst Klein, Niedergrundau, Fed. Rep. of Germany

[73] Assignee: Inventio AG, Hergiswil, Switzerland

[21] Appl. No.: 843,150

[22] Filed: Feb. 28, 1992

[30] Foreign Application Priority Data

Mar. 1, 1991 [CH] Switzerland ..... 629/91

[51] Int. Cl.[5] ..... B66B 9/00

[52] U.S. Cl. ..... 187/1 R; 187/95; 52/30

[58] Field of Search ..... 187/1 R, 95, 6, 20; 52/30, 741, 745; 29/429

[56] References Cited

U.S. PATENT DOCUMENTS 3,851,736 12/1974 Westlake et al. ..... 187/95
4,345,671 8/1982 Tosato et al. ..... 187/95
5,065,843 11/1991 Richards ..... 187/1 R

FOREIGN PATENT DOCUMENTS 1495075 9/1966 France .
8904807 6/1989 World Int. Prop. O. .

*Primary Examiner*—D. Glenn Dayoan
*Assistant Examiner*—Kenneth Noland
*Attorney, Agent, or Firm*—Sandler, Greenblum & Bernstein

[57] ABSTRACT

For assembling hoistway or elevator shaft equipment, there is moved in vertical direction within the hoistway, an erection scaffolding comprising a first working platform, a second working platform, a third working platform and a fourth working platform. The first working platform is arranged at the lower end and the second working platform at the upper end of a elevator car support frame serving for the reception of the elevator cabin following completion of the erection operations. The erection scaffolding continues above the elevator car support frame with the third working platform and ends with the fourth working platform. A suspension tube, a lower deflecting roller and an upper deflecting roller serve as a suspension system for the elevator car support frame. The lower deflecting roller is arranged at the upper end of the suspension tube and the upper deflecting roller is arranged at an elevator hoistway support. A cable, suspended at an, for instance, 3:1 mechanical advantage ratio of a hoist anchored at the elevator car support frame, interconnects these lower and upper deflecting rollers. The elevator hoistway support carries a velocity limiter and a hoist comprising a hoist or tackle drum which serves for the transport of materials. A hoist or tackle cable is directed to a working location by a cantilever crane arranged at the upper end of the suspension tube. The working platforms, which are accessible by way of ladders and trap doors, are secured by railings and hinged barriers.

15 Claims, 4 Drawing Sheets

Fig- 4
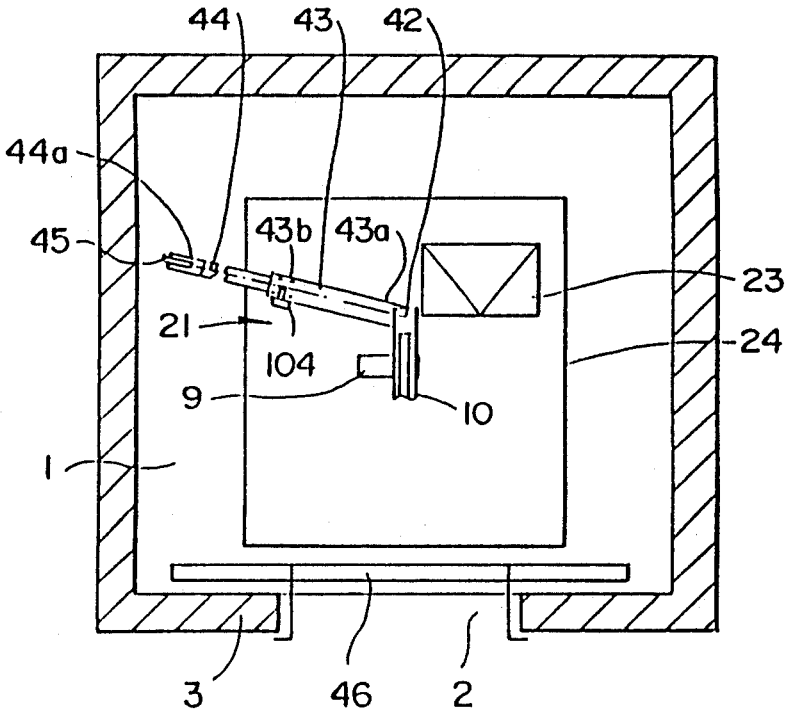
Fig- 5
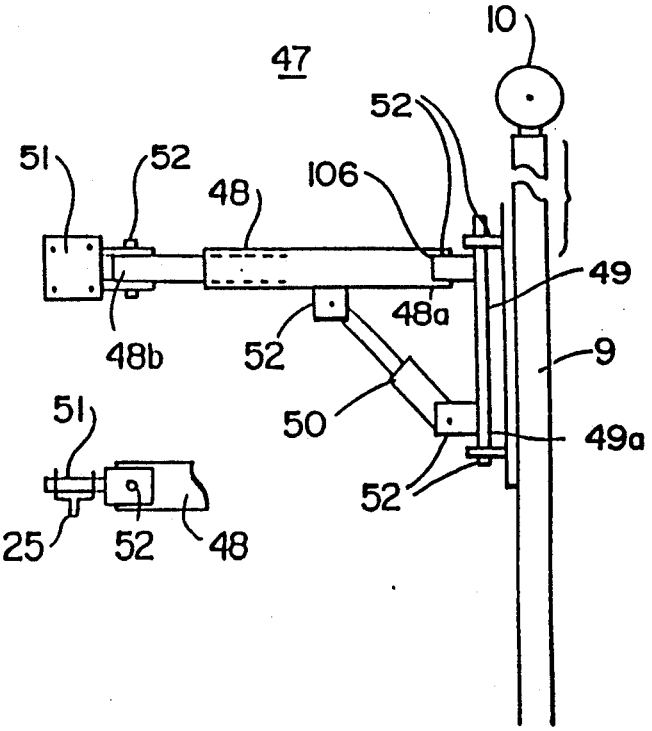
Fig- 6

ERECTION SCAFFOLDING WHICH IS MOVABLE IN AN ELEVATOR SHAFT FOR THE MOUNTING OF SHAFT EQUIPMENT

BACKGROUND OF THE INVENTION

1. Field of the Invention

The present invention relates to a new and improved erection scaffolding which is movable in an hoistway or elevator shaft for the mounting of hoistway or shaft equipment.

Generally speaking, the erection scaffolding of the present development, which is movable in an hoistway or elevator shaft, for the mounting of shaft equipment is of the type comprising a hoist or hoisting tackle for the vertical lifting of an elevator car support frame or sling, at the lower and upper ends of which there are arranged working platforms.

2. Discussion of the Background and Material Information

In U.S. Pat. No. 3,851,736, granted Dec. 3, 1974, there is disclosed an erection method and apparatus in which the guide rails provided for the highest hoistway or shaft section are suspended in the hoistway or elevator shaft at a rig provided with hooks and are raised by means of a hoist or conveying winch through one guide rail length. Then the guide rails for the second highest hoistway or shaft section are suspended at the lower ends of the suspended guide rails and again lifted up through one guide rail length. This procedure is repeated until the guide rail strand or track for the elevator cabin and the counterweight extend throughout the entire height of the hoistway. After the rig has been fastened at the upper end of the hoistway or elevator shaft, the guide rails of the lowermost hoistway or shaft section are connected with the hoistway or elevator shaft wall and the support frame or sling of the elevator car intended to be used is inserted into the hoistway. The higher situated guide rails are subsequently connected with the hoistway or elevator shaft wall from the support frame or sling serving as working platform and which is driven by the hoist or conveying winch.

A drawback of this prior art hoistway equipment erection apparatus resides in the need to use a mechanically complicated rig which must be adaptable to the cross-section of the hoistway or elevator shaft and must contain means or structure for bearing upon the upper rim of the hoistway or elevator shaft. A further disadvantage of this known erection apparatus is that exact alignment of the guide rails is rendered more difficult by the suspended guide rail strand or track. Another shortcoming of such erection apparatus is attributable to the fact that the support frame or sling serving as the working platform is already guided by the guide rails which are to be fastened and aligned, whereby the erection work is associated with increased difficulties.

SUMMARY OF THE INVENTION

Therefore, with the foregoing in mind, it is a primary object of the present invention to provide an improved construction of erection scaffolding which is movable in an hoistway or elevator shaft for the mounting of hoistway or shaft equipment, which is not afflicted with the aforementioned shortcomings and drawbacks of the prior art.

Another and more specific object of the present invention aims at the provision of an improved construction of erection scaffolding which is movable in an hoistway or elevator shaft for the mounting of hoistway or shaft equipment, which allows for an extensive rationalization of the erection operations, particularly when confronted with considerable heights or distances through which the hoistway equipment must be moved, while avoiding the disadvantages of the heretofore considered prior art erection method.

Still a further noteworthy object of the present invention relates to an improved construction of erection scaffolding which is movable in an hoistway for the mounting of hoistway equipment and renders possible the simultaneous performance of erection operations or work at different levels, and the erection operations or work can be carried out prior to completion of the building while it is still under construction, something of particular significance when employing a climbing building construction technique.

A further significant object of the present invention relates to an improved construction of erection scaffolding which is movable in an hoistway for the mounting of hoistway equipment, wherein guidance of the support frame or sling accommodating the working platforms is accomplished by guide rails which have been previously mounted and aligned, and thus, a catching device arranged at the support frame or sling and which coacts with a velocity limiter or speed governor, can be already beneficially employed as safety equipment during the erection operations performed at the guide rails.

Now in order to implement these and still further objects of the present invention, which will become more readily apparent as the description proceeds, the erection scaffolding which is movable in an elevator hoistway or elevator shaft for the mounting of hoistway or shaft equipment of the present development is manifested, among other things, by the features that above the upper end of the elevator car support frame there are arranged additional working platforms supported by the elevator car support frame. From these additional working platforms there can be mounted elevator car guide rails which lead the elevator car support frame, so that the elevator car support frame can be guided by conventional roller guides at the finished mounted elevator car guide rails and can be secured by means of the conventional catching device.

According to a further aspect, the elevator car support frame comprises an upper crossbeam, and a suspension tube projects beyond the uppermost situated working platform and engages with the upper crossbeam of the elevator car support frame.

It is possible for the suspension tube to comprise a two-part suspension tube embodying a lower tube part having a bifurcated or forked end and an upper tube part provided with crane attachment plates and a lower deflecting roller.

As to a further feature of the present invention, there is provided suspension means for substantially vertical lifting the erection scaffolding. Such suspension means comprises an elevator hoistway support, an upper deflecting roller arranged at the elevator hoistway support, the lower deflecting roller, a cable trained about the upper deflecting roller and the lower deflecting roller, and the hoist. Moreover, the suspension means is advantageously structured to provide a mechanical advantage ratio of 3:1.

According to another aspect of the present invention, bearing brackets are located in the hoistway for supporting the elevator hoistway support. There is provided a hoist including a cable drum, and a velocity limiter. The hoist including the cable drum and the velocity limiter are carried by the elevator hoistway support.

Still further, there can be provided a lower crossbeam, corner post bracket means carrying the working platforms, and supports disposed at the lower crossbeam and engaged by the corner post bracket means carrying the working platforms.

The present invention also envisages providing bracing means and guy cables for interconnecting the corner post bracket means in order to stiffen the erection scaffolding.

Still further, there may be provided railings and stays for securing the working platforms, and ladders and trap doors for providing access to the working platforms.

It is further contemplated that a cantilever crane is provided with a crane roller, and such cantilever crane is arranged at the suspension tube. Further, there can be provided means including a cable drum and a tackle cable for the transport of material, and the tackle cable is led off to or directed towards a working site.

There also may be provided crane attachment plate means. The cantilever crane advantageously can comprise a first arm and a second arm, means for hingedly connected the first arm with the crane attachment plate means, means for hingedly connected the second arm at the first arm, and detent means for retaining the first arm and the second arm in a predetermined operative position.

There is further contemplated that telescopically extensible cantilever means are arranged at the suspension tube. This telescopically extensible cantilever means comprises a telescopically extensible arm, a support, an hydraulic jack, and mounting means.

According to a further embodiment of the present invention suspension bracket means can be provided in lieu of the elevator car support frame and the suspension tube. The suspension bracket means extend beyond the height of the erection scaffolding. Still further, there is here provided a lower crossbeam, an upper crossbeam, the lower crossbeam and the upper crossbeam interconnecting the suspension bracket means. Moreover, the catching device and the roller guides are arranged at the lower crossbeam, and a cantilever crane and deflecting rollers are arranged at the upper crossbeam.

Some of the more notable advantages realized with the inventive erection scaffolding comprise the ability to simultaneously perform erection operations at different levels, and that the erection operations can be initiated prior to completion of the building while it is still under construction, something of particular significance when employing a climbing construction mode. Also, guidance of the elevator car support frame receiving the working platforms is accomplished by guide rails which have been previously mounted and aligned, and thus, the catching device arranged at the elevator car support frame and which coacts with the velocity limiter or speed governor, can be already beneficially employed as safety equipment during the erection operations performed at the guide rails.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures there have been generally used the same reference characters to denote the same or analogous components, and wherein:

FIG. 4 schematically illustrates in top plan view details of the uppermost working platform of the erection scaffolding depicted in FIG. 1;

FIG. 5 schematically illustrates a telescopically extensible device or jib for the positioning of guide rails;

FIG. 6 illustrates details of the telescopically extensible device or jib of FIG. 5.

DETAILED DESCRIPTION OF THE PREFERRED EMBODIMENTS

Figure 1:
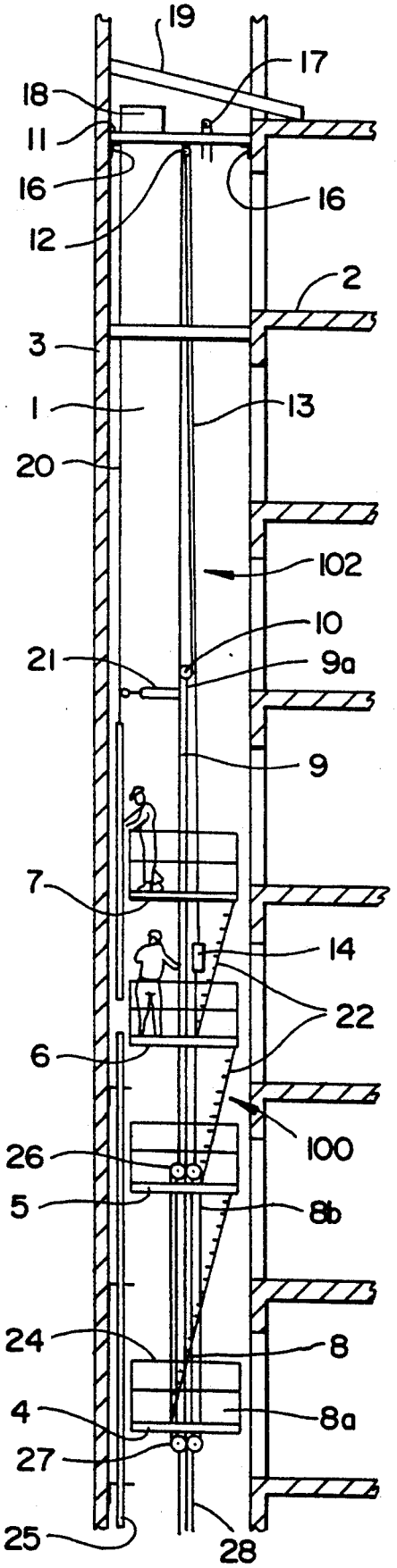
FIG. 1 schematically illustrates in fragmentary partially sectional view an exemplary embodiment of erection scaffolding constructed according to the present invention and the associated hoistway or elevator shaft in which there is movable such erection scaffolding.

Describing now the drawings, it is to be understood that only enough of the construction of the erection scaffolding which is movable in an hoistway or elevator shaft for the mounting of hoistway or shaft equipment has been depicted therein, in order to simplify the illustration, as needed for those skilled in the art to readily understand the underlying principles and concepts of the present invention.

Turning attention now to the drawings, reference numeral 1 denotes an hoistway or elevator shaft which extends throughout several floors or landings 2 of a building structure and which is surrounded by shaft walls 3. An erection scaffolding 100 or the like is movable in substantially vertical direction within the hoistway or elevator shaft 1 for the erection of hoistway or shaft equipment. This erection scaffolding 100 comprises a first working platform 4, a second working platform 5, a third working platform 6, and a fourth working platform 7. The first working platform 4 is arranged at the lower end **8*a* of an elevator car support frame 8 and the second working platform 5 is arranged at the upper end 8*b* of this elevator car support frame 8 which receives or accommodates the elevator car after completion of the erection operations. The erection scaffolding 100 continues with the third working platform 6 located above the elevator car support frame 8 and terminates with the fourth working platform 7**.

A suspension means or system 102 serves for the suspension of the elevator car support frame 8. This suspension means or system 102 comprises a suspension tube 9, a lower deflecting roller 10 arranged at the upper end **9*a* of the suspension tube 9, and an upper deflecting roller 12 arranged at an hoistway or elevator shaft support or support member 11. The lower deflecting roller 10 and the upper deflecting roller 12 are interconnected by a cable or rope 13 of a hoist or tackle means 14 anchored at the elevator car support frame 8. The cable 13** is suspended to provide, for instance, a mechanical advantage or mechanical advantage ratio of 3:1.

Figure 2:
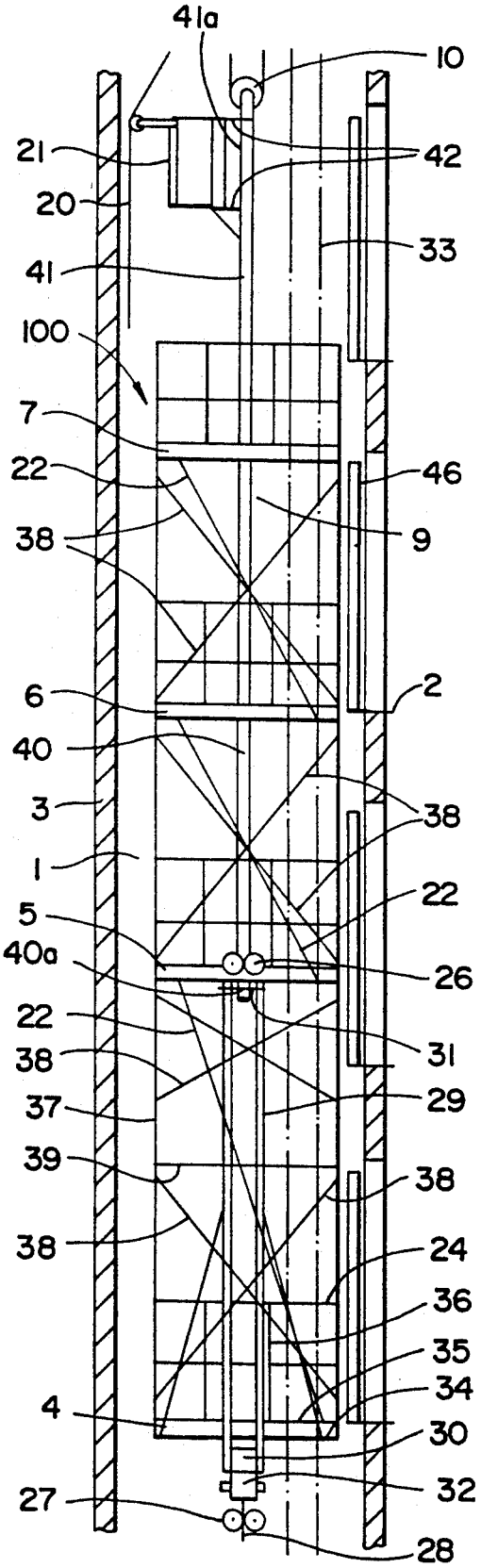
FIG. 2 schematically illustrates details of the erection scaffolding depicted in FIG. 1.
Figure 3:
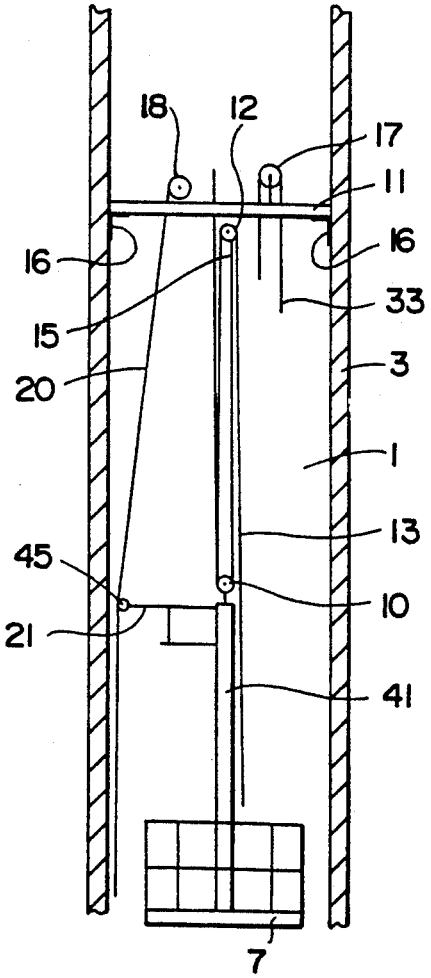
FIG. 3 schematically illustrates details of the suspension for the erection scaffolding depicted in FIG. 1.

Continuing, and with specific reference to FIGS. 1 to 3, it will be understood that reference numeral 15 denotes the fastening point for the cable 13 at the upper deflecting roller 12. The hoistway or elevator shaft support or support member 11, reposing upon bearing brackets or angle members 16 or equivalent structure arranged in the hoistway or elevator shaft 1, carries a conventional velocity or speed limiter or speed governor 17 as well as a hoist or tackle with cable drum, generally indicated by reference numeral 18 and is covered by a protective frame 19 or equivalent structure. The tackle with cable drum 18 serves for the transport of materials, as particularly illustrated in FIG. 1. Thus, it will be seen, a tackle cable or rope 20 is led off to or directed towards a predetermined working site or location by means of a cantilever or jib crane 21 arranged at the region of the upper end 9*a* of the suspension tube 9. The working platforms 4, 5, 6 and 7, which are accessible by means of ladders 22 and trap doors 23 (see FIGS. 1 and 4), are secured by railings 24 and not particularly illustrated hinged or articulated barriers.

FIG. 1 further depicts the mounting of counterweight guide rails 25 at the region of the third and fourth working platforms 6 and 7, respectively. Although not here particularly illustrated, it will be understood that at the same time there are mounted from all of the working platforms 4, 5, 6 and 7, for instance, parts of hoistway or elevator shaft closures and electrical installations. The elevator car support frame 8 is guided along an elevator car guide rail 28, which extends beyond the second working platform 5, by means of an upper roller guide 26 and a lower roller guide 27. A not particularly illustrated but conventional rail limit switch with a switch roller which travels upon the rail end face and actuates a working contact for the control of the hoist or tackle 14 means, is arranged at the upper roller guide 26. As soon as the switch roller departs from the rail, then the hoist or tackle means 14 switches off without, in that case, the upper roller guide 26 being moved beyond the rail end.

FIG. 2 illustrates details of the elevator car support frame 8 which is composed of suspension brackets 29, a lower crossbeam 30 and an upper crossbeam 31. A conventional catching device or safety gear 32 arranged at the lower crossbeam 30 cooperates by means of a not particularly depicted linkage or rod structure with a limiter cable 33 (see also FIG. 3) of the velocity or speed limiter 17, so that excess or unwanted speeds of the erection scaffolding 100 in downward direction are advantageously avoided. Supports 34 mounted on the lower crossbeam 30, a base 35 equipped with railings 24 and struts or stays 36 formed, for instance, of flat steel, form the first working platform 4. Corner post brackets 37 or equivalent support structure, which carry the upper working platforms 5, 6 and 7, are mounted at not particularly illustrated end plates or the like of the supports 34. Guy cables or ropes 38 and bracings 39 are provided for the stiffening or reinforcement of the erection scaffolding.

The suspension tube 9 is here shown to consist of a two-part suspension tube 40, 41, which comprises a lower tube part 40 containing a bifurcated or fork-shaped end 40*a*. This lower tube part 40 of the suspension tube 9 is connected via a not particularly illustrated intermediate member with the upper crossbeam 31. Crane attachment plates 42 or the like and the lower deflecting roller 10 are arranged at the upper end 41*a* of the upper part 41 of the suspension tube 9. As particularly well seen by referring to FIG. 4, already mounted hoistway or elevator shaft doors are indicated by reference numeral 46.

Such FIG. 4 also depicts details of the cantilever or jib crane 21. It will be seen that a first arm or arm member 43 is hingedly connected at one end 43*a* at the crane attachment plates 42. A second arm or arm member 44, which carries at its outer end 44*a* a crane roller 45 which leads away or deflects the tackle cable or rope 20, is hingedly connected or articulated at the other end 43*b* of the first arm 43. The hinges are provided with suitable locking or detent bolts or pins, merely generally indicated by reference numeral 104. The cantilever or jib crane 21 is dimensioned such that all fixation or attachment points of the guide rails are accessible.

According to a further embodiment of the cantilever or jib crane 21, there is portrayed in the showing of FIGS. 5 and 6 a telescopically extensible jib or cantilever 47 which is arranged at the suspension tube 9 at the working height of the uppermost working platform 7. A telescopically extensible arm or arm member 48 is hingedly connected or articulated at one end 48*a*, by a pivot or hinge device 106, with a support or support member 49 arranged at the suspension tube 9. This telescopically extensible arm 48 is supported by an hydraulic jack 50 or equivalent structure engaging at the lower end 49*a* of the support or support member 49. At the hoistway-side or end 48*b* of the telescopically extensible arm 48 there is hingedly connected a mounting or holder 51 at which there is, for instance, centrally connected or clamped the guide rail 25 which is to be mounted.

It will be understood that reference numerals 52 represent the centers of rotation or pivot points, where there are hingedly interconnected or articulated the telescopically extensible arm 48, the support 49, the hydraulic jack 50 and the mounting or holder 51. Furthermore, there is provided an arrangement of the support 49 at the side of the hoistway door. During the erection operations, guide rails are hoisted by means of the hoist or tackle with cable drum 18 to a location which is a few centimeters above the erection or mounting height and then fixedly clamped at the mounting or holder 51. Thereafter, the telescopically extensible arm 48 is lowered by means of the hydraulic jack 50 until the relevant guide rail has reached its final position. After threadably interconnecting fish plate and fastening bracket, the mounted guide rail is released from the mounting or holder 51 and the tackle cable or rope 20.

Figure 7:
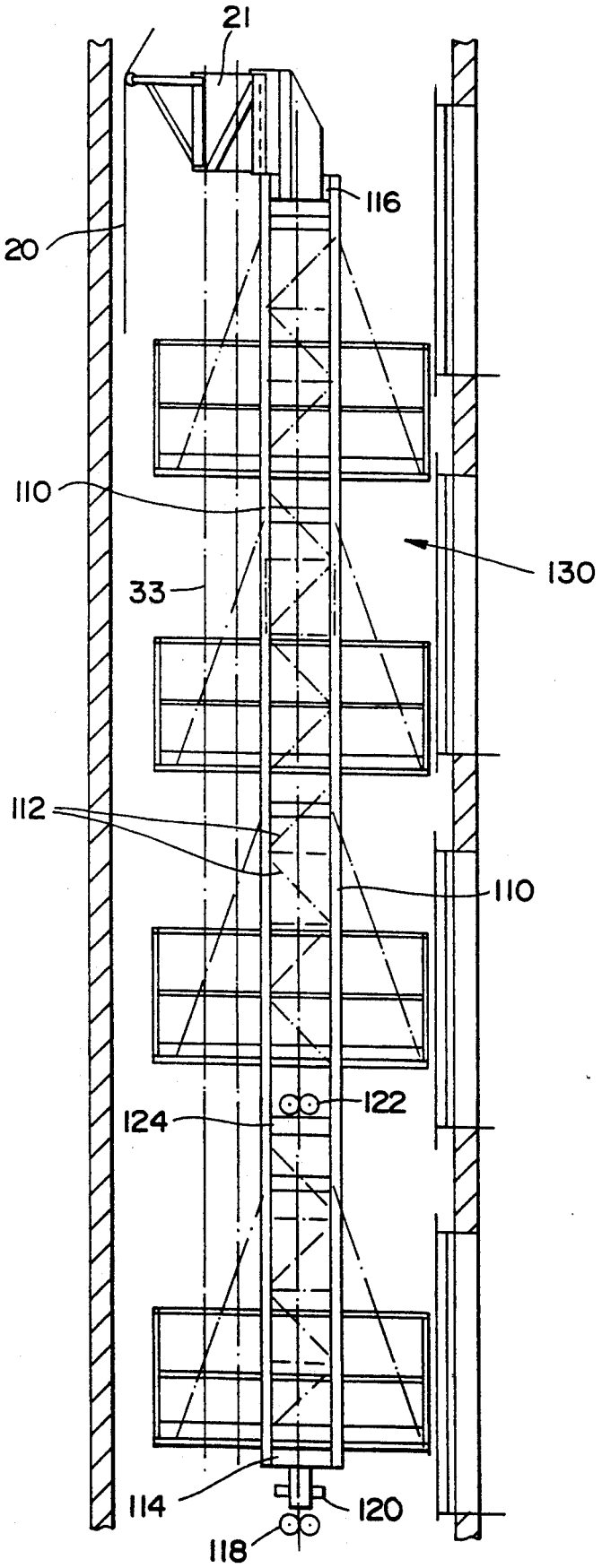
FIG. 7 schematically illustrates in fragmentary partially sectional view a further exemplary embodiment of erection scaffolding constructed according to the present invention and the hoistway or elevator shaft within which there is movable such erection scaffolding.

According to a further embodiment of the present invention as depicted in FIG. 7, in lieu of the elevator car support frame 8 and the suspension tube 9, there can be provided hanging or suspended brackets 110 or the like which extend throughout the entire height of the erection scaffolding 130. These suspended brackets 110 are reinforced by bracing members 112 and are connected by means of a lower crossbeam 114 and an upper crossbeam 116. In this case, the lower roller guide 118 and the catching device or safety gear 120 are mounted at the lower crossbeam 114 and the upper roller guide 122 is mounted at an intermediate crossbeam 124 arranged at the height of the support frame. The cantilever or jib crane 21 and two cable rollers, not depicted in FIG. 7 to simplify the illustration, but like, for instance, the cable roller 10 of FIG. 1, are arranged at the upper crossbeam 116. The erection scaffolding 130, which is independent of the elevator car support frame, is suspended to provide a mechanical advantage or mechanical advantage ratio in the ratio of 4:1.

While there are shown and described present preferred embodiments of the invention, it is distinctly to be understood the invention is not limited thereto, but may be otherwise variously embodied and practiced within the scope of the following claims.

What is claimed is:

1. An erection scaffolding which is movable in an hoistway for the mounting of hoistway equipment, comprising:
   an elevator car support frame having an upper end and a lower end and mountable in the hoistway;
   working platforms arranged at the upper and lower ends of the elevator car support frame;
   a hoist for the vertical lifting of the elevator car support frame together with the working platforms within the hoistway;
   additional working platforms supported by the elevator car support frame arranged above the upper end of the elevator car support frame; and
   the additional working platforms enabling mounting of elevator guide rails ahead of the elevator car support frame within the hoistway to form finished mounted elevator guide rails, so that the elevator car support frame can be guided by roller guides at the finished mounted elevator car guide rails and secured by a catching device.

2. The erection scaffolding according to claim wherein:
   one of the additional working platforms defines an uppermost situated working platform;
   the elevator car support frame comprises an upper crossbeam; and
   a suspension tube projecting beyond the uppermost situated working platform and engaging with the upper crossbeam of the elevator car support frame.

3. The erection scaffolding according to claim 1, wherein:
   the suspension tube comprises a two-part suspension tube;
   said two-part suspension tube comprising:
      a lower tube part having a bifurcated end; and
      an upper tube part provided with crane attachment plates and a lower deflecting roller.

4. The erection scaffolding according to claim 3, further including:
   suspension means for the substantially vertical lifting of the erection scaffolding;
   said suspension means comprising:
      an elevator hoistway support;
      an upper deflecting roller arranged at the elevator hoistway support;
      the lower deflecting roller;
      a cable trained about the upper deflecting roller and the lower deflecting roller; and
      the hoist.

5. The erection scaffolding according to claim 4, wherein:
   the suspension means is structured to provide a mechanical advantage ratio of 3:1.

6. The erection scaffolding according to claim 4, further including:
   bearing brackets located in the hoistway for supporting the elevator hoistway support;
   hoist means including a cable drum;
   a velocity limiter; and
   said hoist means including the cable drum and said velocity limiter being carried by the elevator hoistway support.

7. The erection scaffolding according to claim 1, further including:
   a lower crossbeam;
   corner post bracket means carrying the working platforms; and
   supports disposed at the lower crossbeam and engaged by the corner post bracket means carrying the working platforms.

8. The erection scaffolding according to claim 7, further including:
   bracing means and guy cables for interconnecting the corner post bracket means in order to stiffen the erection scaffolding.

9. The erection scaffolding according to claim 1, further including:
   railings and stays for securing the working platforms; and
   ladders and trap doors for providing access to the working platforms.

10. The erection scaffolding according to claim 2, further including:
   a cantilever crane provided with a crane roller;
   said cantilever crane being arranged at the suspension tube;
   means including a cable drum and a tackle cable for the transport of material; and
   the tackle cable being led off to a working site.

11. The erection scaffolding according to claim 10, further including:
   crane attachment plate means;
   the cantilever crane comprising a first arm and a second arm;
   means for hingedly connected the first arm with the crane attachment plate means;
   means for hingedly connected the second arm at the first arm; and
   detent means for retaining the first arm and the second arm in a predetermined operative position.

12. The erection scaffolding according to claim 2, further including:
   telescopically extensible cantilever means arranged at the suspension tube;
   the telescopically extensible cantilever means comprising:
      a telescopically extensible arm,
      a support;
      an hydraulic jack; and
      mounting means.

13. The erection scaffolding according to claim 1, further including:
   suspension bracket means provided in lieu of the elevator car support frame and a suspension tube;
   the suspension bracket means extending beyond a predetermined height of the erection scaffolding;
   a lower crossbeam;
   an upper crossbeam;
   the lower crossbeam and the upper crossbeam interconnecting the suspension bracket means;
   the catching device and the roller guides being arranged at the lower crossbeam; and
   a cantilever crane and deflecting rollers arranged at the upper crossbeam.

14. The combination of an erection scaffolding and an elevator hoistway, the elevator scaffolding being movable in the elevator hoistway for the mounting of hoistway equipment, comprising:

suspension bracket means;

the suspension bracket means extending beyond a predetermined height of the erection scaffolding;

a lower crossbeam;

an upper crossbeam;

the lower crossbeam and the upper crossbeam interconnecting the suspension bracket means;

a catching device and roller guides arranged at the lower crossbeam;

a cantilever crane and deflecting rollers arranged at the upper crossbeam;

working platforms arranged at the suspension bracket means;

additional working platforms supported by the suspension bracket means above the working platforms;

a hoist for the vertical lifting of the working platforms and the additional working platforms within the elevator hoistway; and the additional working platforms enabling mounting of elevator guide rails within the elevator hoistway to form finished mounted elevator guide rails, so that the suspension bracket means can be guided by the roller guides at the finished mounted elevator car guide rails and secured by the catching device.

15. The combination of erection scaffolding and an elevator hoistway, the erection scaffolding being movable in the elevator hoistway of the mounting of hoistway equipment, comprising:

an elevator car support frame having an upper end and a lower end and arranged in the elevator hoistway;

working platforms arranged at the upper and lower ends of the elevator car support frame;

hoist means for the vertical lifting of the elevator car support frame together with working platforms within the elevator hoistway;

additional working platforms supported by the elevator car support frame arranged above the upper end of the elevator car support frame;

elevator car guide rails which lead to the elevator car support frame mountable within the elevator hoistway from the location of the additional working platforms to form finished mounted elevator guide rails;

roller guide for guiding the elevator car support frame at the finished mounted elevator car guide rails; and a safety gear for securing the elevator car support frame.

* * * * *